US005794934A

United States Patent [19]

Malcolm

[11] Patent Number: 5,794,934

[45] Date of Patent: Aug. 18, 1998

[54] CARD GAME METHOD

[76] Inventor: James C. Malcolm, 1770 South Ocean Blvd., Apartment 204, Pompano Beach, Fla. 33062

[21] Appl. No.: 584,405

[22] Filed: Jan. 11, 1996

[51] Int. Cl.[6] ..... A63F 1/00

[52] U.S. Cl. ..... 273/292

[58] Field of Search ..... 273/292, 293, 273/303, 274

[56] References Cited

U.S. PATENT DOCUMENTS

| | | | |
|---|---|---|---|
| 4,743,022 | 5/1988 | Wood | 273/85 CP |
| 5,248,142 | 9/1993 | Breeding | 273/138 R |
| 5,251,897 | 10/1993 | Fulton | 273/85 CP |
| 5,288,081 | 2/1994 | Breeding | 273/292 |
| 5,356,140 | 10/1994 | Dabrowski et al. | 273/85 CP |
| 5,382,025 | 1/1995 | Sklansky et al. | 273/292 |
| 5,411,257 | 5/1995 | Fulton | 273/85 CP |
| 5,417,430 | 5/1995 | Breeding | 273/292 |
| 5,437,451 | 8/1995 | Fulton | 273/138 A |
| 5,437,462 | 8/1995 | Breeding | 273/292 |
| 5,489,101 | 2/1996 | Moody | 273/292 |
| 5,531,448 | 7/1996 | Moody | 273/292 |
| 5,573,249 | 11/1996 | Johnson | 273/292 |
| 5,584,485 | 12/1996 | Jones et al. | 273/292 |
| 5,584,486 | 12/1996 | Franklin | 273/292 |
| 5,593,161 | 1/1997 | Boylan et al. | 273/292 X |

FOREIGN PATENT DOCUMENTS

| | | | |
|---|---|---|---|
| 9419074 | 9/1994 | WIPO | 273/292 |

*Primary Examiner*—William E. Stoll
*Attorney, Agent, or Firm*—Frank L. Kubler

[57] ABSTRACT

A card playing surface is provided including double common card placement areas. For each player the surface includes a first hand stacking area and a combined hand stacking area and first, second and third wagering token placement areas. A method of playing cards includes the steps of each player placing a first wager of any amount with wagering tokens onto the first wager placement area and placing a second wager of a fixed amount with tokens onto the second wager placement area. The dealer deals five cards face down onto the first hand stacking area for each player, and two common cards face down onto the double common card placement areas. Each player examines his or her cards and chooses whether to additionally enter a second phase where the five card hands of entering players are combined with the two common cards to form seven card hands. Each player expresses this choice by either leaving the five cards in the first hand stacking area to play the first phase only or moving the five cards to the combined hand stacking area to additionally enter the second phase. Second phase players place another wager equal to the fixed seven card wager by placing tokens onto the third wager placement area. All players compare their five card hands with predetermined hand rankings to determine whether and how much the house pays each. The second phase players compare their seven card combined hands to determine who has the highest hand and thus wins.

11 Claims, 3 Drawing Sheets

PAYOFF CHART
5 CARD

| | |
|---|---|
| ROYAL FLUSH | 1000 TO 1 |
| STRAIGHT FLUSH | 200 TO 1 |
| 4 OF A KIND | 50 TO 1 |
| FULL HOUSE | 11 TO 1 |
| FLUSH | 8 TO 1 |
| STRAIGHT | 5 TO 1 |
| 3 OF A KIND | 3 TO 1 |
| 2 PAIR | 2 TO 1 |
| 1 PAIR (10'S OR BETTER) | 1 TO 1 |

FIG. 2

PROGRESSIVE JACKPOT
PAYOUTS

| | |
|---|---|
| FLUSH | $ 50.00 |
| FULL HOUSE | $100.00 |
| FOUR OF A KIND | $250.00 |
| STRAIGHT FLUSH | 10% OF PRIZE POOL |
| ROYAL FLUSH | 100% OF PRIZE POOL |

FIG. 3

CARD GAME METHOD

BACKGROUND OF THE INVENTION

1. Field of the Invention

The present invention relates generally to the field of card playing methods and games. More specifically the present invention relates to a card playing surface including a double common card placement area, and for each player a slot for receiving a wagering token, a first hand stacking area and a combined hand stacking area and first, second and third wager placement areas. The present invention also relates to a card playing game method having a first phase played with a first hand of five cards against the house and paid according to a table of hand ranks, and an optional second phase played with a combined hand of seven cards, including the first hand and the two common cards, against other players.

The method includes the steps of each player placing a first wager of any amount for the first phase with wagering tokens onto the first wager placement area and placing a second wager of a fixed amount for the second phase with wagering tokens onto the second wager placement area; the dealer dealing five cards face down onto the first hand stacking area in front of each player; the dealer dealing two common cards face down onto the double common card placement area in front of the dealer; giving each player the chance to examine their cards to make a choice of whether to play their five cards only or to additionally enter the second phase wherein the five card hands of entering players are combined with the two common cards in front of the dealer to form seven card hands, each player expressing this choice by either leaving their five cards in the first hand stacking area to play the first phase only or moving their five cards to the combined hand stacking area to additionally enter the second phase; the second phase players placing another wager equal to the fixed seven card wager by placing wagering tokens onto the third wager placement area; all players comparing their five card hands with predetermined hand rankings on a table to determine whether and how much the house pays each given player for the first phase; the dealer turning up the two common cards; the second phase players comparing their seven card combined hands with the combined hands of other second phase players to determine which second phase player has the highest seven card hand and thus wins. A progressive jackpot phase is also preferably provided.

2. Description of the Prior Art

There have long been card playing methods for determining the outcomes of wagers.

Breeding, U.S. Pat. No. 5,417,430, issued on May 23, 1995, discloses a progressive wagering method and game. The '430 Breeding method includes the steps of each player placing a first wager to participate in a wagering game and a second wager to participate in a progressive jackpot game; dealing cards to each player and dealing at least one common card; giving each player the chance to withdraw at least part of the first wager based on the player's cards; providing a hand for each player, each player's hand including the at least one common card and the cards each player was dealt; and resolving each player's first wager based on the hand, where if a player's hand includes a predetermined arrangement of cards, that player wins a preselected amount, and resolving each player's second wager based on the hand, where if a player's hand includes a predetermined arrangement of cards, that player wins an immediate bonus jackpot payout, and further where if a player's hand includes a preselected one of the predetermined arrangements of cards, that player becomes eligible for a super jackpot payout. A problem with Breeding is that the players are always playing against the house, and it is possible that no player will win during a game. This can lead to player frustration and avoidance of future games. Another problem is that a key feature of the game is that of permitting a player to essentially back out of the game by withdrawing part of his or her wager. There can be minimal excitement in a game of chance centered around players backing away with second thoughts.

Two related patents issued to Breeding are U.S. Pat. Nos. 5,288,081, issued on Feb. 22, 1994, and 5,437,462, issued on Aug. 1, 1995, which disclose methods of playing a wagering game. These Breeding patents teach a method of playing such a game for a number of players using standard playing cards having a standard rank, the card game involving standard poker hand ranking and including the steps of each player placing a wager to participate in the game; dealing cards to each player and at least one common card, all of the cards being dealt face down; giving each player the chance to examine the cards received by that player and to withdraw at least part of the wager based on the rank of the player's cards; showing the at least one common card, thereby providing a hand for each player, each player's hand including the shown at least one common card and the cards each player was dealt; and resolving each player's remaining wager, which was not withdrawn based on the rank of that player's hand. The problems with the method of the Breeding '081 and '462 patents are the same as those identified for the Breeding '430 patent.

Another U.S. Pat. No. 5,248,142 to Breeding, issued Sep. 28, 1993 is directed to a wagering game method. Breeding '142 reveals a game between a dealer and several players which is played with symbols. A different symbol is distributed to each player, and each player places a first wager by placing wagering indicators in wager placing areas on a playing surface. Several unique symbols, each designating a different player, are placed on the playing surface. A symbol corresponding to a given player is randomly selected, resolving the first wager by paying out to players who correctly wagered on which player would have the selected symbol and collecting from those who did not. The dealer distributes the gaming symbols to each player and the dealer, beginning with the first player. The players arrange their gaming symbols in a predetermined relationship for interpretation of rank for each player and the dealer. The players place second wagers. The dealer resolves the second wager by paying out to players who correctly wagered that a rank of their gaming symbol relationship beat the dealer's rank, and collects from those players who did not. A problem with Breeding '142 is that all games are played with the house so that it is possible that no player wins.

Wood, U.S. Pat. No. 4,743,022, issued on May 10, 1988, discloses a second chance poker method. As in prior second chance poker methods, a player is dealt a hand of five cards and then given a second chance by optionally discarding up to the entire five cards for replacement. In Wood, the player then wins or loses based upon comparison of the resulting hand with a posted, fixed hand ranking according to posted odds. Then Wood proceeds further to permit the player to place a second wager and draw a sixth card to form a third hand consisting of any of the five cards from the immediately previous hand and the sixth card. Yet the player is offered this second chance only if the sixth card would create the possibility of a new hand of a straight or higher. If the immediately previous hand already had a rank of straight or higher, then the player is offered the second chance only if the sixth card might create a still higher ranking. A problem with Wood is that the player may participate in the second chance phase only under certain very limited circumstances, and will usually be frustrated in his or her wish to proceed to this phase. Another problem with Wood is that the players are always playing against the house, so that there are games in which no player wins.

Dabrowski, et al., U.S. Pat. No. 5,356,140, issued on Oct. 15, 1994, teaches a double poker game in which each player is dealt two hands from separate decks. The player selects one hand and the other hand is discarded entirely. The player plays out the selected hand according to conventional poker rules. The wager of each player is resolved by comparison of the hand to a preselected winning hand combination chart and is paid out according to ratios on the chart. Dabrowski, et al., gives the player a wide selection of cards by presenting two hands at the outset, but does not provide a second chance to win. And, once again, the wagers are made with the house, so that for each given game it is possible that no player will win.

Fulton, U.S. Pat. No. 5,437,451, issued on Aug. 1, 1995, reveals a draw stud poker-type card game. A player wagers and then is dealt a hand of cards. Then the player is given a choice of replacing one of the cards with another card from the deck called a first replacement card. Then the player is provided with a second optional card and the choice of keeping or discarding the second optional card. The player receives a second replacement card if he or she discards the second optional card. The player's final hand is compared to a predetermined winning payout schedule. Problems with Fulton are that the player has only one chance to win, and since all games are played against the house, it is possible that no player will win any given game. These factors diminish the incentive to participate.

Fulton, U.S. Pat. No. 5,411,257, issued on May 2, 1995, and Fulton, U.S. Pat. No. 5,251,897, issued on Oct. 12, 1993, both teach a method of playing a poker-type game. In both instances, the method includes the general steps of a player making an initial wager and several playing cards being displayed to the player. The player aspires to obtain a hand with at least one of a pre-determined number of winning card arrangements. The next step is for the player to decide whether to make a limited additional wager to give the player an opportunity to increase his or her winning payout even though that player may have already received a definite indication of success. The player is then dealt additional cards to complete his or her hand. This final hand is compared with the pre-selected several winning card arrangements. If the player has at least one of the winning card arrangements, the player is provided with a payout sum. The problems identified for Fulton '451 are again presented.

Other potentially relevant patents are U.S. Pat. Nos. 5,167,413, issued on Dec. 1, 1992 for a method and apparatus for playing a poker-type game, and 5,377,973, issued on Mar. 1, 1995, for a method and apparatus for playing casino card games including a progressive jackpot.

It is thus an object of the present invention to provide a card playing method which includes placing a first wager against the house and an optional additional wager against other players to provide a second chance to win, both from a single hand of cards dealt to each player and also from that single hand in conjunction with at least one unknown common card so that at least one of the players is certain to win.

It is another object of the present invention to provide such a method which is easy to understand and exciting to play.

It is still another object of the present invention to provide such a method which optionally includes a progressive feature wherein specific predetermined hands win a jackpot, and wherein players enter by making an optional wager and the jackpot amount rolls over into the next game if there are no winners during any given game, to progressively increase the jackpot.

It is finally an object of the present invention to provide such a method which may be practiced on an inventive playing surface such as that of a table or a board having markings for common cards, for both first and combined hands of playing cards and for wagering tokens.

SUMMARY OF THE INVENTION

The present invention accomplishes the above-stated objectives, as well as others, as may be determined by a fair reading and interpretation of the entire specification.

A card playing surface is provided, including a common card placement area for at least one common card, and for each player a first hand stacking area for a first hand including at least one player card, and a combined hand stacking area for the first hand when the first hand is to be played both independently and combined with the common card.

A method of playing cards is provided including the steps of a player placing a first wager of any amount and a second wager of a fixed amount, a dealer providing at least one player card to the player to form a first hand, the dealer providing an opportunity for the player to evaluate the first hand to decide whether to place a third wager, resolving the first wager based upon the rank of the first hand, where the second player decides to place the third wager, showing the player at least one common card to provide a combined hand including the first hand and the at least one common card to the player, and resolving the second and third wagers based upon the rank of the combined hand.

A method of playing cards is also provided including the steps of a player placing a first wager; a dealer providing at least one player card to the player to form a first hand; the dealer providing an opportunity for the player to evaluate the first hand to decide whether to place a second wager; resolving the first wager based upon the rank of the first hand; where the second player decides to place the second wager, showing the player at least one common card to provide a combined hand including the first hand and the at least one common card to the player; and resolving the second wager based upon the rank of the combined hand. The at least one player card is preferably five player cards. The at least one common card is preferably two common cards. The first wager is preferably played against the house and the first wager is preferably resolved by comparing the rank of the first hand against a set of pre-determined hand rankings and wager odds. The there are preferably several players, each player being dealt one first hand and the second wager is preferably resolved by comparing said rank of the combined hand held by each player with ranks of combined hands of other players participating in the second wager. The method preferably includes the additional steps of providing a playing surface including a common card placement area, and for each player a first hand stacking area and a combined hand stacking area, and moving the first hand from the first hand stacking area to the combined hand stacking the upon election by the player to place the second wager. The method preferably includes the additional step of providing at least one wagering token placement area. The method preferably includes the additional steps of providing a first wagering token placement area for placing tokens for the first wager and a second wagering placement token area for placing tokens for the second wager. The method preferably includes the additional steps of providing a slot for receiving a jackpot wagering token and thereby entering a jackpot contest by placing a wagering token into the slot. The method preferably includes the still additional step of rolling over the amount of the jackpot to a subsequent game if there are no winners for a given game, so that the amount of the jackpot progressively increases from one game to a subsequent game where there are no jackpot winners for the given game.

BRIEF DESCRIPTION OF THE DRAWINGS

Various other objects, advantages, and features of the invention will become apparent to those skilled in the art from the following discussion taken in conjunction with the following drawings, in which:

FIG. 2 is an exemplary table of hand rankings and corresponding payout odds for resolving wagers for the first hand, and is one of many possible such tables for use with the claimed method.

FIG. 3 is an exemplary table of hands winning the optional progressive jackpot amount, and is one of many possible such tables for use with the claimed method.

DETAILED DESCRIPTION OF THE PREFERRED EMBODIMENTS

Figure 1:
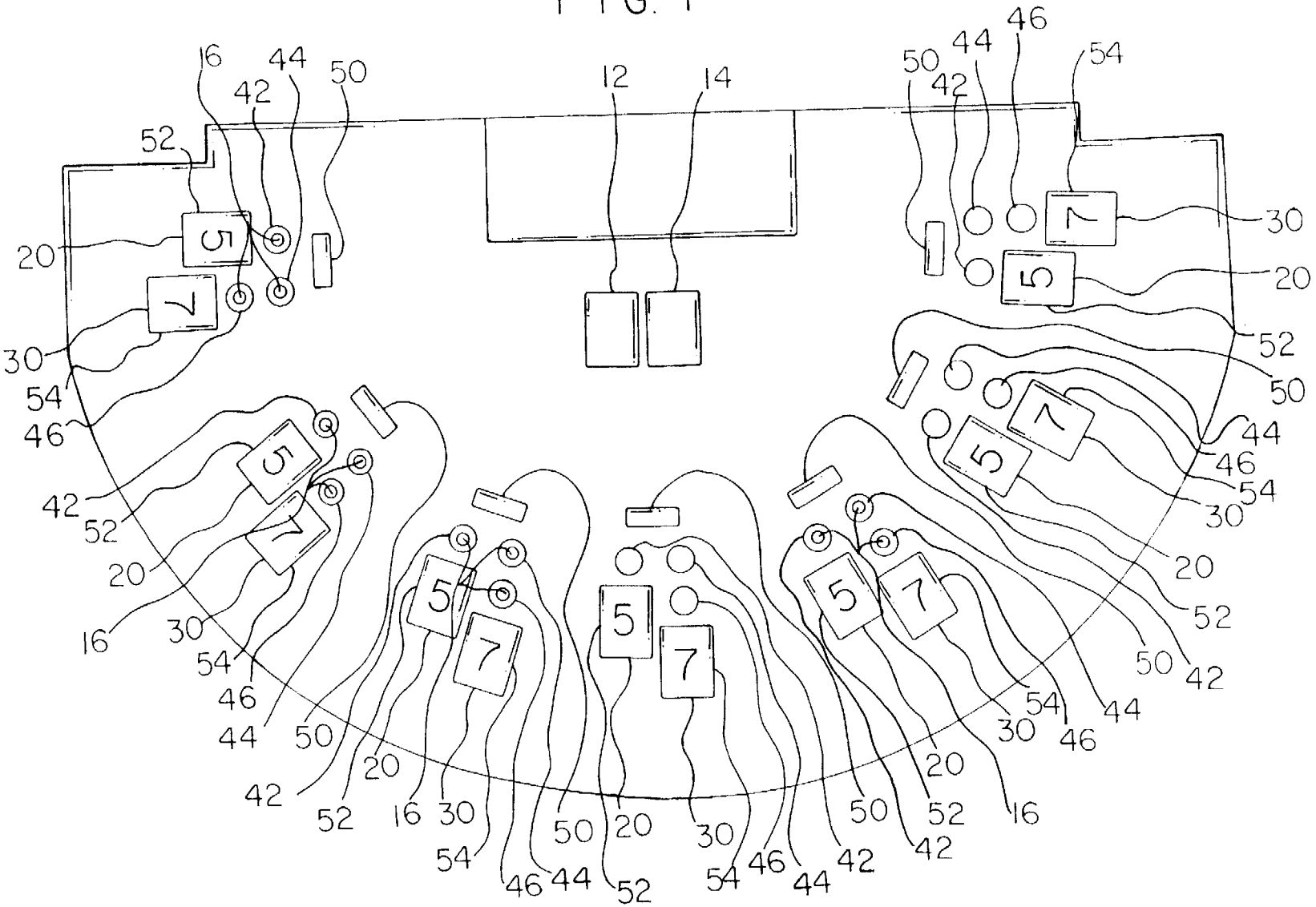
FIG. 1 is a top view of the inventive playing surface.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

FIRST PREFERRED EMBODIMENT

Referring to FIG. 1, a card playing surface 10 is disclosed including double common card placement areas 12 and 14 in front of the dealer. At each player location the surface 10 includes a first hand stacking area 20 and a combined hand stacking area 30 and first, second and third wagering token placement areas 42, 44 and 46 respectively. A slot 50 is preferably provided at each player location for receiving a wagering token 16 such as a chip for the player to enter an optional progressive jackpot game, described below. Playing surface 10 may be, but is not limited to, the upper surface of a table or of a board.

The present invention also relates to a card playing game method having a first phase played with five cards 52 against the house and paid according to a table of hands and odds, and an optional second phase played with seven cards 54 against other players. Contemplated card games include, but are not limited to, poker and blackjack.

METHOD

In practicing the invention, the following method may be used. The method includes the steps of each player placing a first wager of any amount for the first phase with wagering tokens 16 onto the first wager placement area 42 and placing a second wager of a fixed amount for the second phase with wagering tokens 16 onto the second wager placement area 44; the dealer dealing five cards 52 face down onto the first hand stacking area 20 in front of each player; the dealer dealing two common cards face down onto the double common card placement areas 12 and 14 in front of the dealer; giving each player the chance to examine their cards to make a choice of whether to play their five cards 52 only or to additionally enter the second phase wherein the five card hands of entering players are combined with the two common cards in front of the dealer to form seven card hands 54, each player expressing this choice by either leaving their five cards 52 in the first hand stacking area 20 to play the first phase only or moving their five cards 52 to the combined hand stacking area 30 to additionally enter the second phase; the second phase players placing another wager equal to the fixed seven card 54 wager by placing wagering tokens 16 onto the third wager placement area 46; all players comparing their five card hands with predetermined hand rankings on a table (See FIG. 2) to determine whether and how much the house pays each given player for the first phase; the dealer turning up the two common cards; the second phase players comparing their seven card combined hands 54 with the combined hands of other second phase players to determine which second phase player has the highest seven card hand 54 and thus wins. A rotation of beginning players from one hand to the next is a contemplated option for this method.

The game can be played in a live game version. Alternatively an electronic video gaming machine can be programmed to display the game and provide the payouts to the player. The equivalent of this method may be played on several types of computerized machines such as a computer slot machine, and on a video slot machine, an electronic video gaming machine, a computer slot machine, and so forth.

There is finally a third optional phase which has a progressive jackpot amount. Specific predetermined hands win the jackpot, and the amount rolls over into the next game if there are no winners during any given game, to progressively increase the jackpot amount. The player enters by inserting a wagering token 16 into slot 50. The predetermined hands winning the jackpot are preferably those having the rank of a straight or higher. A table of winning hands may be provided, as illustrated in FIG. 3.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A method of playing cards comprising the steps of:

a player placing a first wager of any amount and a second wager of a fixed amount;

a dealer providing at least one player card to said player to form a first hand;

the dealer providing an opportunity for said player to evaluate said first hand to decide whether to place a third wager;

resolving said first wager based upon the rank of said first hand;

where said player decides to place said third wager, showing said player at least one common card to provide a combined hand including said first hand and said at least one common card;

and resolving said second and third wagers based upon the rank of said combined hand.

2. A method of playing cards comprising the steps of:

a player placing a first wager;

a dealer providing at least one player card to said player to form a first hand;

the dealer providing an opportunity for said player to evaluate said first hand to decide whether to place a second wager;

resolving said first wager based upon the rank of said first hand;

where said player decides to place said second wager, showing said player at least one common card to provide a combined hand including said first hand and said at least one common card to said player;

and resolving said second wager based upon the rank of said combined hand.

3. The method of claim 2, wherein said at least one player card is five player cards.

4. The method of claim 2, wherein said at least one common card is two common cards.

5. The method of claim 2, wherein said first wager is played against the house and said first wager is resolved by comparing said rank of said first hand against a set of pre-determined hand rankings and wager odds.

6. The method of claim 2, wherein there are a plurality of said players each being dealt one said first hand and wherein said second wager is resolved by comparing said rank of said combined hand held by each said player with ranks of combined hands of other said players participating in said second wager.

7. The method of claim 2, comprising the additional steps of:

providing a playing surface comprising a common card placement area, and for each player a first hand stacking area and a combined hand stacking area;

and moving said first hand from said first hand stacking area to said combined hand stacking area upon election by said player to place said second wager.

8. The method of claim 7, additionally comprising the step of providing at least one wagering token placement area.

9. The method of claim 8, additionally comprising the steps of providing a first wagering token placement area for placing tokens for said first wager and a second wagering placement token area for placing tokens for said second wager.

10. The method of claim 8, additionally comprising the steps of providing a slot for receiving a jackpot wagering token and thereby entering a jackpot contest by placing a wagering token into said slot.

11. The method of claim 10, additionally comprising the step of rolling over the amount of said jackpot to a subsequent game if there are no winners for a given game, such that said amount of said jackpot progressively increases from one game to a subsequent game where there are no jackpot winners for said given game.

* * * * *